United States Patent [19]

Chupka

[11] Patent Number: 4,806,635

[45] Date of Patent: Feb. 21, 1989

[54] NEW CROSS-LINKING SYSTEM FOR MAKING TONERS THAT ARE USEFUL IN ELECTROPHOTOGRAPHY USING POLYFUNCTIONAL AZIDE

[75] Inventor: Francis L. Chupka, Wilmington, Del.

[73] Assignee: Hercules Incorporated, Wilmington, Del.

[21] Appl. No.: 222,319

[22] Filed: Jul. 21, 1988

Related U.S. Application Data

[60] Continuation of Ser. No. 021,930, Mar. 5, 1987, which is a division of Ser. No. 912,033, Sep. 26, 1986, abandoned.

[51] Int. Cl.[4] ..... G03G 9/08

[52] U.S. Cl. ..... 430/109; 430/137; 430/904

[58] Field of Search ..... 430/109, 904, 137

[56] References Cited

U.S. PATENT DOCUMENTS

| | | | |
|---|---|---|---|
| Re. 31,072 | 11/1982 | Jadwin et al. | 430/99 |
| 3,058,944 | 10/1962 | Breslow et al. | 260/41 |
| 3,211,752 | 10/1965 | Breslow | 260/349 |
| 3,261,785 | 7/1966 | Robinson | 260/2.5 |
| 3,284,421 | 11/1966 | Breslow | 260/80.5 |
| 3,585,103 | 6/1971 | Thomson | 161/191 |
| 4,217,406 | 8/1980 | Tanaka et al. | 430/137 |
| 4,460,748 | 7/1984 | Raner | 525/256 |
| 4,565,763 | 1/1986 | Uchiyama et al. | 430/109 |

*Primary Examiner*—J. David Welsh

*Attorney, Agent, or Firm*—Joanne W. Patterson

[57] ABSTRACT

Disclosed is a toner composition useful for electrophotography consisting of (1) the reaction product of a polyfunctional azide and a cross-linkable toner resin that is a copolymer of a styrene material and an acrylate or methacrylate, or a polyester resin that is the reaction product of a dicarboxylic acid and a dihydric alcohol, and (2) a colorant.

2 Claims, No Drawings

NEW CROSS-LINKING SYSTEM FOR MAKING TONERS THAT ARE USEFUL IN ELECTROPHOTOGRAPHY USING POLYFUNCTIONAL AZIDE

This application is a continuation of application Serial No. 021,930 filed Mar. 5, 1987, now abandoned. Application Ser. No. 021,930 is a division of application Ser. No. 912.033 filed Sep. 26, 1986, now abandoned.

This invention relates to toners that are useful in electrophotographic machines. More particularly, it relates to a process for making toners that contain cross-linked toner resins.

Toners useful in dry electrophotographic development can be made by melt dispersing a colorant in a resin and grinding the cooled product to a desirable particle size. Cross-linked resins are used to reduce the problem of off-setting, which can occur in machines equipped with hot-roll fusing systems. However, while dispersing well in noncross-linked resins, colorants disperse poorly in such resins after they are crosslinked. And, poor colorant dispersion causes poor photographic reproduction.

U.S. Pat. Nos. 4,217,406 and 4,565,763 disclose processes whereby noncross-linked or slight cross-linked resins are simultaneously cross-linked and melt-blended with a colorant and then ground to a dry toner. However, these processes are limited to only certain functional groupcontaining resins. Thus, known toner resins that do not contain such functional groups cannot be used in the disclosed systems.

It would be advantageous to design a system for simultaneously melt-blending and cross-linking toner resins in which a broad range of resins would be useful. However, such a system must be designed so that colorants and other additives melt-blended with the resin do not adversely affect the cross-linking reaction.

According to the instant invention a process for making a toner comprising the steps of melt-blending a resin with a colorant and subsequently grinding the blend is characterized in that the resin is cross-linked during the melt-blending step by melt-blending the resin and colorant at a temperature sufficient to cross-link the resin in the presence of a polyfunctional azide having the formula $$(N_3\overset{\overset{\displaystyle O}{\|}}{C}O)_y-R-(SO_2N_3)_z$$

where R is an organic radical, y and z are integers from 0 to 10, and the sum of y and z is an integer from 2 to 10. Unexpectedly, needed colorants and other useful toner additives do not significantly interfere with the ability of the polyfunctional azide to cross-link the resin.

The resin useful according to this invention is any organic resin having a carbon-hydrogen bond. It can be a resin that is already slightly cross-linked, but due to dispersibility problems the resin is preferably a linear or branched noncross-linked resin. Resins which have been found especially useful in this invention are copolymers of from about 40 to about 90 percent by weight of a styrene material, preferably styrene, and from about 10 to about 60 percent by weight of another vinyl monomer other than styrene, for example, an alkyl acrylate or methacrylate, including branched alkyl and cycloalkyl acrylates and methacrylates such as cyclohexyl methacrylate, having up to 20 more more carbon atoms in the alkyl group. Other useful resins are terpolymers of 40 to 90 percent by weight styrene, from about 5 to about 50 percent by weight of a lower alkyl acrylate or methacrylate having from 1 to 4 carbon atoms in the alkyl moiety such as methyl, ethyl, isopropyl, or butyl, and from about 5 to about 50 percent by weight of a higher alkyl acrylate or methacrylate having from about 6 to 20 or more carbon atoms in the alkyl group such as ethylhexyl acrylate or methacrylate.

A "styrene material" includes a monomer, or mixture of monomers, having the formula

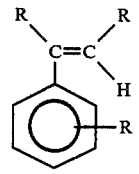

where R is hydrogen, halogen, lower alkyl (i.e., $C_1$–$C_4$ alkyl), and halogenated lower alkyl.

Other especially useful resins in this invention are polyesters comprised of one or more dicarboxylic acids and one or more dihydric alcohols which are capable of reacting with one another to form a polymer having the individual units thereof linked by ester groups. Examples of dicarboxylic acids which may be used in the preparation of the polyester resins are terephthalic acid and isophtalic acid, including substituted terephtalic and isophtalic acid, and cyclohexane dicarboxylic acid. Examples of dihydric alcohols which may be used in the preparation of the polyesters are aromatic alcohols such as a bis(hydroxy alkoxy-phenyl) alkane having from 1 to about 4 carbon atoms in the alkoxy group and from 1 to about 10 carbon atoms in the alkane group, cyclohexane dialkanols having from 2 to about 10 carbon atoms in the alkanol groups, and alkylene glycols such as tetramethylene glycol having from 2 to about 10 carbon atoms in the alkylene group.

Examples of resins useful in this invention are found in U.S. Pat. Nos. 3,938,992, 4,217,406, and 4,565,763, the disclosures of which are incorporated herein by reference.

The polyfunctional azide useful according to this invention is a well known cross-linking agent. The preferred azides are disulfonazides (i.e., in the above described formula y=o, z=2), wherein R is aliphatic, aromatic, or cycloaliphatic, and diazidoformates (i.e., y=2, z=o), wherein R is aliphatic, cycloaliphatic, or aromatic when separated from the azidoformate groups by an aliphatic group. Examples of the useful polyfunctional azides are found in U.S. Pat. Nos. 3,261,785, 3,058,944, 3,284,421, and 3,585,103, the disclosures of which are incorporated herein by reference. The amount of polyfunctional azide cross-linker used is from about 0.1% to about 10%, preferably from about 0.5% to about 2%, based on the weight of the resin used. The specific amount required depends on the molecular weight of the resin and can be determined by one skilled in the art.

The colorant used in the instant invention is any compound listed in the Colour Index, Second Edition, Vol. 1 and 2 (Bradford Yorkshire: The Society of Dyers and Colourists, 1956). Examples of such colorants are found in the hereinabove mentioned U.S. Pat. Nos. 3,938,992 and 3,565,763. Preferably, the amount of colorant used is about 2% to about 20%, preferably from about 8% to about 10%, based on the weight of the toner (i.e., cross-linked resin, colorant, and optional ingredients).

Useful optional ingredients in making toners according to the instant invention are known in the art, e.g., surfactants, conductive materials and magnetic materials. Examples are found in U.S. Pat. Nos. 3,577,345, incorporated herein by reference, and the heretofore mentioned U.S. Pat. Nos. 3,938,992 and 4,565,763.

Melt-blending is carried out according to this invention at a temperature and for a time sufficient to react substantially all of the polyfunctional azide cross-linking agent with the resin. This temperature and time depend on the azide cross-linking agent used and can be determined by one skilled in the art. Preferably, the temperature ranges from about 140° C. to about 220° C. For example, when using the preferred disulfonazides, the preferred temperature is about 170° C. to about 220° C., and when using the preferred diazidoformates the preferred temperature is about 140° C. to about 170° C. Preferably, the time is from about 1 minute to about 1 hour, depending on the temperature used. Generally, at least about 5 times the azide's half-life (i.e., time required to decompose one-half of the azide; at a given temperature is needed.

The noncross-linked resin is preferably cross-linked according to this invention to an amount sufficient to extend the useful fusing range of the noncross-linked resin by at least about 10° C., most preferably at least about 20° C. The "useful fusing range" is known in the art as the temperature range within which the toner will hot-roll-fuse to the paper in an electrophotographic copier without fracturing and sticking to the roll. The number of degrees in the range is the "fusion latitude." Tests for determining the useful fusing range are well known, e.g., as disclosed in the heretofore mentioned U.S. Pat. No. 3,938,992.

The characteristic time ($T_w$) of a given resin is useful in predicting its useful fusing range. The $T_w$ of the resin can be calculated using measurements made using a mechanical spectrometer. In the spectrometer, resin samples are placed between two parallel plates one of which can be made to oscillate at frequencies varying from $w=0.1$ radians $sec^{-1}$ to $w=400$ radians $sec^{-1}$. Two types of tests can be run: frequency scans and temperature scans.

In the frequency scan, the sample is placed between two parallel plates of 12.5mm in diameter with a 2mm gap between plates (during the test). The temperature is held constant and frequencies from 0.1 to 400 radians $sec^{-1}$ are examined. Viscoelastic properties such as the elastic or storage modulus, G' (dynes $cm^{-2}$), loss modulus, G'' (dynes $cm^{-2}$) and the complex viscosity, n* (poise) are obtained. The extent of cross-linking can be observed by comparing values of G' and n*. This relationship is the characteristic time described by the formula $$T_w = \frac{G'}{n^* w^2}$$

where $T_w$ is the characteristic time at frequency w, G' is elastic modulus (dynes $cm^{-2}$), n* is complex viscosity (poise), and w is frequency (radians $sec^{-1}$). The characteristic time is the time it takes a deformed polymer to reattain its equilibrium configuration within the polymer network. It is evident that the characteristic time is the ratio of the polymer's elastic to viscous response upon application of stress. Long characteristic times are desirable for use in heat-pressure fusing systems. If the characteristic time is short compared to the duration of the applied stress, the polymer will tend to fracture in the melt and offset will result. Preferably, the toners of this invention have a $T_{w=1}$ (140° C.) of greater than about 0.3 sec, more preferably greater than about 0.4 sec.

Grinding according to the instant invention is done by methods known to those skilled in the art, e.g., as disclosed in U.S. Pat. No. 4,555,466 and 4,543,312, the disclosures of which are incorporated herein by reference. Of course, it will be apparent to those skilled in the art that the toner must be allowed to cool after cross-linking to below the glass transition temperature ($T_g$) of the cross-linked resin before grinding can begin. The $T_g$ of the resins that are crosslinked according to this invention will vary over a wide range, generally from about 50° C. to about 90° C. Preferably, grinding is performed using a fluid energy mill.

The toners made according to this invention can be mixed with a carrier to form a two-component developer. Mixing is usually done by dry blending. The carriers can be nonmagnetic or magnetic. Nonmagnetic carriers include glass beads, inorganic crystals (e.g. sodium chloride), hard resin particles, metal particles, etc. Ferromagnetic materials include iron, cobalt, nickel, and various alloys. Magnetic carriers can be coated with film forming polymers as described in the following patents: Miller, U.S. Pat. No. 3,547,822, Dec. 15, 1970; U.S. Pat. No. 3,632,512, Jan. 4, 1972; McCabe, U.S. Pat. No.3,795,617; Kasper, U.S. Pat. No. 3,795,618; the disclosures of which are incorporated herein by reference. Other useful coatings include fluoropolymers e.g., polytetrafluoroethylene, polyvinylidene fluoride, and their copolymers.

A two-component developer made according to this invention comprises about 1–15 weight % toner and 85–99 weight % carrier. Average carrier particle diameter is 30–1200 microns, preferably 60–200 microns. Examples of useful carriers are found in the heretofore mentioned U.S. Pat. No. 3,938,992.

Toners made according to the instant invention can contain magnetic materials, as described above, such as iron particles or iron oxide. Toners of this type are called single component developers, which dispense with the separate carrier required in the two-component developers. A single component developer made according to the instant invention contains about 30–70% by weight magnetic material.

To more accurately define the instant invention, the following Examples are included. However, the invention is not limited thereto. All parts and percentages in the Examples are by weight unless indicated otherwise. All molecular weights in the Examples are weight average unless otherwise indicated.

EXAMPLE 1

A melt blender equipped with a sigma type roller design (Plasticorder, C. W. Brabender, Inc.) is heated to 175° C. and charged with 53 parts of an 80% styrene, 20% n-butylacrylate copolymer with a $M_w$ (weight average molecular weight as measured by size exclusion chromatography) of approximately 80,000 having a melt index (150° C., 2.16$K_g$) of 8.8 g/10 minutes and 0.9275 parts of disulfonazido tridecane (80% isomeric di substitution and 20% mono and tri substitution).

The mixture is masticated for 30 minutes at 175° C. and 70 rpm. The product is partially gelled, therefore no molecular weight data is obtainable.

The $T_{w=1}$ (140° C.) of the product is 0.76 sec. The product has a melt index (measured at 150° C., 2.16 Kg) of 0.25g/10 minutes.

A control is made with no diazide cross-linker. The product is soluble in organic solvents with a $M_w$ of 77,000 and a $M_N$ (number average molecular weight as measured by size exclusion chromatography) of 40,600. Characteristic time calculated from the rheological data is $T_{w=1}$ (140° C.)=0.152 sec.

EXAMPLE 2

To show that the cross-linking ability of the polyfunctional azides is not significantly adversely affected in the instant invention, cross-linking is carried out in the presence and absence of a colorant, i.e., carbon black.

For the control (no colorant) a preheated Plasticorder is charged with 100 parts of the styrene n-butyl acrylate copolymer used in Example 1 and 1.5 parts of 1,10-disulfonazidodecane. The mixture is masticated at 175° C. and 70 rpms for 45 minutes to cross-link the resin. Eleven parts of carbon black is then added and mixed for an additional 15 minutes at 175° C. and 70 rpm. The characteristic time of the contro is $T_{w=1}$ (140° C.)=0.984 sec.

In the Example, a preheated Plasticorder is charged as in the control, but 11 parts of carbon black are also added before cross-linking, initially and the mixture is then masticated at 175° C. and 70 rpms for 60 minutes. $T_{w=1}$ (140° C.) is 0.888 sec. Comparing characteristic times shows that cross-linking is not significantly affected by the presence of a colorant.

EXAMPLE 3

A mixture of 100 parts of the styrene-n-butylacrylate copolymer used in Example 1 and 1.5 parts of p,p'-oxybis(benzenesulfonazide) is charged to a Plasticorder along with colorants and other toner additives and masticated at 175° C. for 30 minutes. The product contains 17% gels and has a characteristic time, $T_{w=1}$ (140° C.), of 0.93 sec.

EXAMPLE 4

This Example is similar to Example 3, but the resin employed is a 57% styrene/43% n-butylmethacrylate resin, $M_w$ of ca. 70,000. The product contains 40.8% gels and exhibits a characteristic time, $T_{w=1}$, (140° C.), of 0.86 sec.

EXAMPLE 5

This Example is similar to Example 3, but a 90% styrene/10% n-butylacrylate copolymer with a weight average molecular weight of 45,000 and 2.0 parts diazide are employed. The product has a gel content of 27%, and characteristic time, $T_{w=1}$ (140° C.), of 0.87 sec.

EXAMPLE 6

To show that the use of polyfunctional azides according to the instant invention increases the fusion latitude of the toner, the following experiment is conducted.

As a control, 540 parts of a 50% styrene/30% methyl methacrylate/20% 2-ethylhexyl acrylate terpolymer with a $M_w$ of approximately 60,000 and 60 parts of carbon black (Black Pearls 1000, Cabot Corp.) are melt blended on a two roll mill at 175° C. The mixture is cooled to room temperature and toner is made by the conventional process of pulverizing the product in an impact mill (Wiley Mill) and a fluid energy mill followed by particle classification to give a toner with an average particle diameter of approximately 10 microns. A developer is made by tumbling the toner (4% by weight) with metal carrier beads (NV-30, International Communication Materials Industries). A commercially available electrophotographic copier (Royal 115, Konishiroku Photo Industry Co., Ltd.) that is charged with the developer is used to measure fusion latitude (i.e., off-set temperature minus minimum fusing temperature). The copier is modified so that the surface temperature of the fusing roll can be varied and measured. Speed of the fusing roll is 2.125 inches per second, and the pressure at the nip of the fusing and pressure rolls is 19 pounds per linear inch. Paper bearing an image of unfused toner is passed through the nip of the rolls. The lowest temperature at which the toner fuses to the paper without off-set (minimum fusing temperature) is determined using an adhesive tape test. A 19 mm wide strip of adhesive tape (Scotch 810 Magic Transparent Tape, 3M Corporation) is applied to a roll-fused image and immediately peeled away at an angle of 180° C. The minimum fusing temperature is the lowest temperature at which no toner pulls off with the tape. Off-set temperature (lowest temperature at which toner adheres to the fusing roll) is determined by increasing fusing temperature in 10° C. increments above the minimum fusing temperature.

As an example of the instant invention, the two roll mill is charged with 534.6 parts of the control terpolymer, 5.4 parts of p,p'-oxybis (benzene sulfonazide) and 60 parts of carbon black (Black Pearls 1000). The mixture is maintained at 175° C. After 15 minutes the mixture exhibits considerable viscosity increase and mixing is continued to a total time of 60 minutes. Toner and developer are made as in the control. The fusion latitude (determined as in the control) of the cross-linked product is greater than 65° C. The minimum fixation temperature is 145° C. and no off-set is observed at any temperature tested through 210° C.

I claim:

1. A toner composition useful for electrophotography consisting essentially of (1) the reaction product of (a) a cross-linkable toner resin selected from the group consisting of a copolymer of a styrene material and an acrylate or methacrylate, and a polyester that is the reaction product of a dicarboxylic acid and a dihydric alcohol, and (b) from about 0.1% to about 10%, based on the weight of the resin, of a polyfunctional azide having the formula $$(N_3\overset{\overset{\displaystyle O}{\|}}{C}O)_y-R-(SO_2N_3)_z$$

where R is an organic radical, y and z are integers from 0 to 10, and the sum of y and z is an integer from 2 to 10, and (2) from about 2% to about 20%, based on the total weight of the composition, of a colorant.

2. The composition of claim 1, wherein the polyfunctional azide is a diazidoformate or a disulfonazide.

* * * * *

UNITED STATES PATENT AND TRADEMARK OFFICE

CERTIFICATE OF CORRECTION

PATENT NO. : 4,806,635

DATED : February 21, 1989

INVENTOR(S) : Francis L. Chupka

It is certified that error appears in the above-identified patent and that said Letters Patent is hereby corrected as shown below:

Column 2, line 30;

"isophtalic" should read --isophthalic--

"terephtalic" should read --terephthalic--

Column 2, line 31;

"isophtalic" should read --isophthalic--

Signed and Sealed this

Fifteenth Day of August, 1989

*Attest:*

*Attesting Officer*

DONALD J. QUIGG

*Commissioner of Patents and Trademarks*